US005710962A

United States Patent [19]

Isoda et al.

[11] Patent Number: 5,710,962

[45] Date of Patent: Jan. 20, 1998

[54] TONER REPLENISHING METHOD FOR USE IN DEVELOPMENT PROCESS, AND DEVELOPMENT UNIT EMPLOYING THE TONER REPLENISHING METHOD

[75] Inventors: Tetsuo Isoda, Numazu; Masanori Suzuki, Shizuoka-ken, both of Japan

[73] Assignee: Ricoh Company, Ltd., Tokyo, Japan

[21] Appl. No.: 591,159

[22] Filed: Jan. 25, 1996

[30] Foreign Application Priority Data

Jan. 30, 1995 [JP] Japan ..... 7-033055
Dec. 28, 1995 [JP] Japan ..... 7-354372

[51] Int. Cl.[6] ..... G03G 15/08

[52] U.S. Cl. ..... 399/260; 222/DIG. 1; 399/253; 399/255

[58] Field of Search ..... 355/260, 245, 355/246, 251; 430/120, 122; 222/DIG. 1; 118/653

[56] References Cited

U.S. PATENT DOCUMENTS 4,478,512 10/1984 Zoltner ..... 355/260
4,576,465 3/1986 Fushida et al. ..... 355/246
4,872,036 10/1989 Homma ..... 355/245 X
5,034,773 7/1991 Nimura et al. ..... 355/246
5,103,765 4/1992 Owada et al. ..... 118/653
5,430,530 7/1995 Ott et al. ..... 355/260
5,557,382 9/1996 Tatsumi et al. ..... 355/260

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A toner replenishing method for use in a development process of developing latent electrostatic images formed on an electrophotographic photoconductor with a two-component dry developer containing a toner and a carrier, the latent electrostatic images being formed on the electrophotographic photoconductor by uniformly charging the electrophotographic photoconductor to a predetermined potential and exposing the electrically charged photoconductor to light images corresponding to original images, includes the step of replenishing the toner only in a portion of the two-component dry developer as the toner concentration thereof is decreased so as to make up for the used toner in the course of the development of the latent electrostatic images.

6 Claims, 1 Drawing Sheet

TONER REPLENISHING METHOD FOR USE IN DEVELOPMENT PROCESS, AND DEVELOPMENT UNIT EMPLOYING THE TONER REPLENISHING METHOD

BACKGROUND OF THE INVENTION

1. Field of the Invention

The present invention relates to a toner replenishing method for use in a development process of developing latent electrostatic images formed on an electrophotographic photoconductor with a two-component dry developer in a variety of image forming apparatuses such as a copying machine and a printer, and a development unit of such image forming apparatuses, which employs the above-mentioned toner replenishing method.

2. Discussion of Background

There is conventionally employed a one-component developer comprising a toner which contains a magnetic material, or a two-component developer comprising a toner and a carrier as a powdered developer in the image forming apparatus.

When the two-component developer is employed, it is necessary to sufficiently mix and stir the carrier and the toner in order to cause triboelectric charging between the carrier and the toner.

Further, in the case of the two-component developer, the carrier is not consumed during the repeated development operations, but gradually deteriorates, so that periodic maintenance is essential. Due to the deterioration of the carrier, the toner particles may be scattered and deposited on the background of a copy-image bearing paper. In particular, the scattering of toner particles and the deposition of toner particles on the background frequently take place immediately after the toner is replenished in the two-component developer. The reason for this is that the replenished toner is sent to a development area before the toner is stirred and mixed with the carrier to such a degree that the charge quantity of the toner is large enough to carry out the development. The above-mentioned problems of the scattering of toner particles and the deposition of toner particles on the background can be solved to some extent when the stirring efficiency of the toner and the carrier is excellent even though the carrier is caused to deteriorate.

Understandably, therefore, an important problem by which the two-component dry developer is confronted is to improve the stirring and mixing efficiency of the carrier and the toner. Thus, an agitating element is conventionally employed in a development unit to improve the stirring and mixing efficiency of the toner and the carrier. However, the use of the agitating element has the drawbacks that the size of the development unit is increased, and the cost is also increased.

According to a conventional toner replenishing method as disclosed in Japanese Laid-Open Patent Application 3-116072, a surplus two-component dry developer which is transported to a development sleeve, but not subjected to development is removed therefrom by a doctor blade and collected in a developer stirring container, and a toner is replenished in the above-mentioned developer from above. By the above-mentioned toner replenishment method, the newly replenished toner cannot be efficiently stirred and mixed with the carrier, and the obtained charge quantity of toner is not enough, so that the scattering of toner particles and the deposition of toner particles on the background cannot be completely solved.

SUMMARY OF THE INVENTION

Accordingly, a first object of the present invention is to provide a toner replenishing method for use in a development process of developing latent electrostatic images formed on an electrophotographic photoconductor with a two-component dry developer comprising a toner and a carrier, capable of efficiently stirring and mixing the toner and the carrier to triboelectrically charge the toner even if the carrier is caused to deteriorate, without the problems of scattering of toner particles and the deposition of toner particles on the background immediately after the replenishment of the toner.

A second object of the present invention is to provide a toner replenishing method for use in a development process using a two-component dry developer, capable of sufficiently charging the toner even in a small-sized development unit.

A third object of the present invention is to provide a development unit for developing latent electrostatic images formed on an electrophotographic photoconductor by a two-component dry developer, in which a carrier and a toner can be efficiently stirred and mixed so as to triboelectrically charge the toner to a sufficient level even when the toner is replenished, with the problems of the scattering of toner particles and the deposition of toner particles on the background being minimized.

The above-mentioned first and second objects of the present invention can be achieved by a toner replenishing method for use in a development process of developing latent electrostatic images formed on an electrophotographic photoconductor with a two-component dry developer comprising a toner and a carrier, the latent electrostatic images being formed on the electrophotographic photoconductor by uniformly charging the electrophotographic photoconductor to a predetermined potential and exposing the electrically charged photoconductor to light images corresponding to original images, comprising the step of replenishing the toner only in a portion of the two-component dry developer as the toner concentration thereof is decreased so as to make up for the used toner in the course of the development of the latent electrostatic images.

For the above-mentioned toner replenishing method, there may be employed a development unit comprising toner replenishing and mixing means for replenishing the toner only in a portion of the two-component developer as the toner concentration thereof is decreased so as to make up for the used toner in the course of the development of the latent electrostatic images, and mixing the replenished toner and the carrier to prepare the two-component dry developer, and a mixing chamber for holding the used dry developer portion with a decreased toner concentration in which the toner is to be replenished, and in this case, it is preferable that the toner be replenished in the two-component developer from a lower portion thereof in the mixing chamber.

Furthermore, it is preferable that the mixing chamber comprise a toner-replenishing opening provided with a mesh screen with a mesh size larger than the particle size of the toner and smaller than the particle size of the carrier.

The third object of the present invention can be achieved by a development unit for developing latent electrostatic images formed on an electrophotographic photoconductor with a two-component dry developer comprising a toner and a carrier, comprising toner replenishing and mixing means for replenishing the toner only in a portion of the two-component developer as the toner concentration thereof is decreased so as to make up for the used toner in the course of the development of the latent electrostatic images, and mixing the replenished toner and the carrier to prepare the two-component dry developer; a mixing chamber for holding the used dry developer portion with a decreased toner concentration in which the toner is to be replenished; a developer container for holding the two-component dry developer; and developer transport means for transporting the two-component developer from the mixing chamber into the developer container.

In the above-mentioned development unit, it is preferable that the mixing chamber comprise a toner-replenishing opening which is located at a lower portion of the mixing chamber and provided with a mesh screen with a mesh size larger than the particle size of the toner and smaller than the particle size of the carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
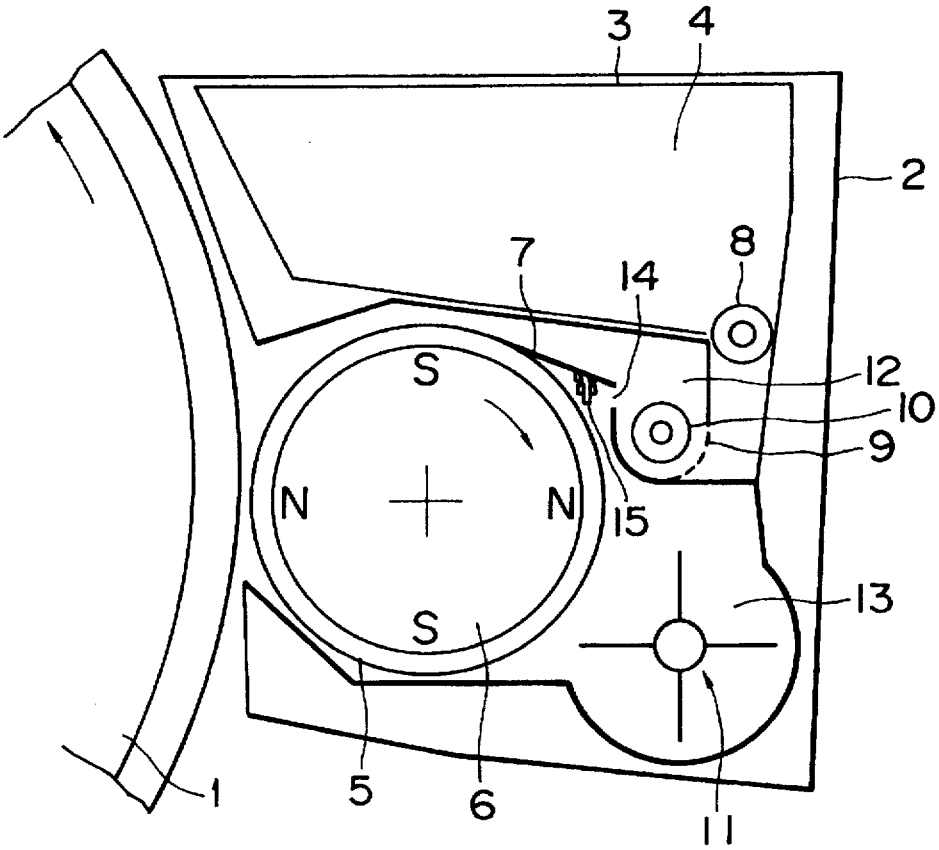
FIG. 1 is a schematic view of a development unit according to the present invention for developing latent electrostatic images formed on an electrophotographic photoconductor with a two-component dry developer, capable of replenishing a toner only in a portion of the two-component dry developer as the toner concentration thereof is decreased so as to make up for the used toner in the course of the development of the latent electrostatic images.

An electrophotographic process roughly includes the steps of charging an electrophotographic photoconductor, exposing the charged photoconductor to light images to form latent electrostatic images thereon, developing the latent electrostatic images to visible toner images by a developer, transferring the toner images to an image receiving member, separating the image receiving member from the photoconductor, fixing the toner images on the image receiving member, quenching the photoconductor, and cleaning the photoconductor. The cycle of the above-mentioned steps is carried out for copying operation.

When a two-component developer is employed for the development step, a toner for use in the two-component developer is consumed and the toner concentration is decreased in a development unit every time the copying operation is carried out. The toner concentration of the developer is detected by a sensor to replenish a toner in the two-component developer. In this case, it is necessary that the replenished toner be efficiently stirred and mixed with the remaining carrier in the development unit.

Generally, a development unit employing a two-component developer comprises stirring means for stirring the carrier and the toner, such as an agitating element or screw, which is called a paddle; a development sleeve having a plurality of magnets therein capable of drawing up the carrier to the surface of the photoconductor; and toner-replenishing means for replenishing a toner in the two-component developer. The newly replenished toner is stirred and mixed with the carrier by the agitating element in the development unit. The collision of the toner with the carrier in the course of stirring and mixing process becomes a very important factor for successfully achieving the development step.

The reason for this is as follows: The energy generated by the stirring process is converted into electric energy through the triboelectric charging. Namely, toner particles are electrostatically attached to the surface of carrier particles to form a two-component developer. In this case, the amount ratio of the toner to the carrier in the two-component developer is called the toner concentration. When the toner concentration is too high, some toner particles cannot be attached to the surface of the carrier particles and remain uncharged. With the increase of the uncharged toner particles, the problems of the scattering of the toner particles and the deposition of the toner particles on the background tend to easily occur. In contrast to this, when the toner concentration is appropriate, all the toner particles can come in contact with the carrier particles, so that the toner particles can be charged and the occurrence of the above-mentioned problems can be minimized.

The two-component developer is drawn up by the development sleeve, and the toner of the two-component developer is subjected to development for achieving the image formation. The toner is therefore consumed and the toner concentration of the two-component developer existing on the development sleeve is decreased. At that time, however, the toner concentration of the two-component developer not drawn up to the development sleeve is not lowered. In other words, the developer drawn up to the development sleeve is only a part of the developer, and the toner concentration is not changed in most part of the developer.

In the conventional development unit, not only the developer with a low toner concentration, which has passed through the development sleeve and has been subjected to development, but also the developer not drawn up to the development sleeve with the toner concentration remaining unchanged is stirred and mixed with the newly replenished toner, so that the stirring efficiency of the toner and the carrier is very poor. As a result, the replenished toner cannot be sufficiently charged. To sufficiently charge the replenished toner under the above-mentioned condition, it is required to increase the capacity of the development unit, thereby increasing the size of the image forming apparatus itself. By the above-mentioned conventional stirring method, the stirring energy is consumed to increase the entropy, so that the efficiency of converting the stirring energy into electric energy is remarkably low.

In addition, the toner is different from the carrier in specific gravity because the toner comprises a resin and a coloring agent as the main components, while the carrier mainly comprises a magnetic material. When the carrier and toner particles with different specific gravities are mixed, the toner particles tend to float over the carrier particles under the influence of gravity. This phenomenon is one of the causes to lower the stirring efficiency of the toner and the carrier.

By the conventional toner replenishing method, the toner is replenished to the two-component developer from above, so that the replenished toner and the carrier cannot be efficiently mixed and stirred because the specific gravity of the toner is smaller than that of the carrier. Furthermore, according to the mixing and stirring manner, the toner concentration of the two-component developer will not become uniform, and the toner and the carrier will tend to separate from each other.

Further, by the conventional toner replenishing method, a toner is supplied to the two-component developer contained in a chamber by means of a toner replenishing roller. Therefore, it is impossible to send the toner into the chamber from a toner-replenishing opening provided at a lower portion of the chamber because the toner-replenishing opening is choked up with the developer. In the case where the toner is replenished in the developer from above, it takes much time to finely ground the aggregates of toner particles if there are a lot of aggregates in the replenished toner particles. Consequently, the toner particles cannot be readily charged to a sufficient level.

With the conventional conditions taken into consideration, it is preferable that the toner be supplied to a mixing chamber containing the two-component dry developer with a decreased toner concentration from a toner-replenishing opening provided at a lower portion of the mixing chamber. In addition, the aforementioned toner-replenishing opening may be provided with a mesh screen having a mesh size larger than a toner particle size and smaller than a carrier particle size.

Other features of this invention will become apparent in the course of the following description of exemplary embodiments, which are given for illustration of the invention and are not intended to be limiting thereof.

EXAMPLE 1

FIG. 1 is a schematic view of a development unit for use in an image forming apparatus which employs a toner replenishing method of the present invention.

Reference numeral 1 indicates an electrophotographic photoconductor; reference numeral 2, a development unit; reference numeral 3, a toner cartridge; and reference numeral 4, a toner container, in which a toner is usually stored. To develop a latent electrostatic image formed on the surface of the photoconductor 1, a two-component developer is drawn up by a development sleeve 5 having a plurality of magnets 6 therein, and transported to a development area of the photoconductor 1.

The toner concentration of the two-component developer subjected to the development is detected by a toner concentration sensor 15. When the toner concentration is decreased during the repeated development operations, a toner replenishing roller 8 is driven in rotation by the toner concentration sensor 15 to let the toner out of the toner container 4.

In FIG. 1, a toner-replenishing opening of a mixing chamber 12 is provided with a mesh screen 9 having a mesh size larger than the particle size of the toner and smaller than the particle size of the carrier, so that the toner particles can enter the mixing chamber 12 through the mesh screen 9. At that time, the carrier in the mixing chamber 12 can be maintained therein without passing through the mesh screen 9. Further, since the toner particles are caused to pass through the mesh screen 9, the agglomerate of toner particles is not prevented from entering the mixing chamber 12. As a result, the probability that the toner particles can come in contact with the carrier particles in the mixing chamber 12 is increased, which is regarded as advantageous to the triboelectric charging of toner particles and carrier particles.

In this embodiment as shown in FIG. 1, the toner is sent from the toner container 4 to the toner-replenishing opening by gravity and the pressure applied by the toner replenishing roller 8. Alternatively, an exhaust nozzle capable of ejecting a gas may be provided to send the toner to the toner-replenishing opening by blowing the compressed gas.

As previously mentioned, the two-component developer is drawn up to the development sleeve 5 and subjected to the development process. The developer on the development sleeve 5 is scraped from the surface thereof by a scraper 7 and collected in the mixing chamber 12. At that time, the toner concentration of the developer passing through the scraper 7 is detected by the toner concentration sensor 15. When a predetermined low toner concentration is detected by the toner concentration sensor 15, the toner is supplied to the mixing chamber 12 from the toner container 4 by rotating the toner replenishing roller 8. In the mixing chamber 12, the two-component developer with a low toner concentration and the replenished toner particles are sufficiently stirred by an agitating element 10. Then, the two-component developer newly obtained in the mixing chamber 12 is sent to a developer container 13 through a developer dropping outlet 14 at an overflow edge of the mixing chamber, and mixed with the remaining developer in the developer container 13 by a paddle 11.

In this embodiment, the toner is supplied to the mixing chamber 12 through the toner-replenishing opening which is provided at a lower portion of the mixing chamber 12, that is, extending to substantially the lowermost portion of the mixing chamber. The toner particles tend to float over the carrier particles because the specific gravity of the toner particle is smaller than that of the carrier particle. Therefore, the toner particles entering the mixing chamber 12 from the lower portion thereof can easily come in contact with the carrier particles, so that the stirring efficiency can be improved.

In the present invention, the change in amount of toner in the two-component developer can be known by using the conventional toner concentration sensor. Therefore, the toner can be replenished only in a portion of the two-component dry developer as the toner concentration thereof is decreased so as to make up for the used toner in the course of the development of the latent electrostatic images, so that the charging efficiency of the toner can be improved.

Figure 2:
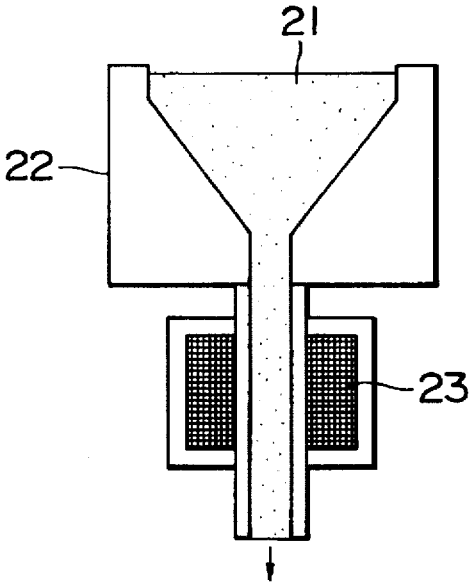
FIG. 2 is a schematic view of a sensor for detecting the permeability of a two-component dry developer for use in the present invention.

As the toner concentration sensor, for example, a sensor capable of detecting the permeability of the developer as shown in FIG. 2 can be used. To be more specific, the permeability detecting sensor as shown in FIG. 2 may be provided by boring the scraper 7 to form a tiny hole therein and fitting a hopper 22 in the tiny hole. As shown in FIG. 1, the position of the tiny hole for the toner concentration sensor 15 on the scraper 7 is determined so that the developer dropping through the hopper 22 may be collected in the developer container 13 through the gap between the development sleeve 5 and the mixing chamber 12.

While the developer 21 is dropping through the hopper 22, the inductance (L) of a coil 23 serving as a resonance circuit varies with the amount of the carrier contained in the developer 21. Namely, the amount of magnetic carrier particles passing through the magnetic field generated by the coil 23 is relatively changed with the amount of the toner particles contained in the developer 21. Therefore, the toner concentration can be obtained from the resonance frequency (f), which is calculated in accordance with the following formula:

$(f)=1/\{2\pi\sqrt{(LC)}\}$, in which C represents the capacitance of the resonance circuit.

In a conventional development unit, which is not equipped with the mixing chamber 12 as shown in FIG. 1, a toner is replenished in a mixture of the two-component developer with a decreased toner concentration and the developer with a normal toner concentration stored in the developer container 13, so that the stirring efficiency of the toner and the carrier is poor. In contrast to this, the toner is added only to the developer with a decreased toner concentration according to the toner replenishing method of the present invention. Therefore, the toner particles can be efficiently charged by coming in contact with the carrier particles, so that the stirring efficiency is improved and the toner particles can be charged stably, with the result that the toner deposition on the background can be minimized.

A commercially available two-component developer (Trademark "FT4000", made by Ricoh Company, Ltd.) was subjected to image formation of 60,000 sheets to intentionally fatigue, and then set in the development unit as shown in FIG. 1. Using the development unit thus prepared, image formation was carried out with the toner being replenished in the developer by the previously mentioned method of the present invention. Immediately after the toner replenishment, the toner deposition on the background of the produced image-bearing sheet was visually observed and evaluated with reference to standard samples.

The results are shown in Table 1. In Table 1, the larger the grade, the less the toner deposition on the background of the sheet.

COMPARATIVE EXAMPLE 1

The development unit 2 shown in FIG. 1 which was employed in Example 1 was modified in such a manner that the mixing chamber 12 was omitted, the mesh screen 9 was not provided, and the agitating element 10 set in the mixing chamber 12 was moved in the developer container 13.

Supplying the thus modified development unit with the same fatigued two-component developer as employed in Example 1, image formation was carried out with the toner being replenished in the developer. Immediately after the toner replenishment, the toner deposition on the background of the produced image-bearing sheet was visually observed and evaluated in the same manner as in Example 1.

The results are shown in Table 1.

EXAMPLE 2

The development unit 2 shown in FIG. 1 which was employed in Example 1 was modified in such a manner that the toner replenishing opening situated at the lower portion of the mixing chamber 12 was not provided with the mesh screen 9.

Supplying the thus modified development unit with the same fatigued two-component developer as employed in Example 1, image formation was carried out with the toner being replenished in the developer. Immediately after the toner replenishment, the toner deposition on the background of the produced image-bearing sheet was visually observed and evaluated in the same manner as in Example 1.

The results are shown in Table 1.

EXAMPLE 3

The development unit 2 shown in FIG. 1 which was employed in Example 1 was modified in such a manner that the position of the toner replenishing opening was shifted from the lower portion to the upper portion of the mixing chamber 12, and the toner replenishing opening was not provided with the mesh screen 9.

Supplying the thus modified development unit with the same fatigued two-component developer as employed in Example 1, image formation was carried out with the toner being replenished in the developer. Immediately after the toner replenishment, the toner deposition on the background of the produced image-bearing sheet was visually observed and evaluated in the same manner as in Example 1.

The results are shown in Table 1.

COMPARATIVE EXAMPLE 2

The development unit 2 shown in FIG. 1 which was employed in Example 1 was modified in such a manner that the scraper 7 was omitted and the agitating element 10 set in the mixing chamber 12 was moved in the developer container 13.

Supplying the thus modified development unit with the same fatigued two-component developer as employed in Example 1, image formation was carried out with the toner being replenished in the developer. Immediately after the toner replenishment, the toner deposition on the background of the produced image-bearing sheet was visually observed and evaluated in the same manner as in Example 1.

The results are shown in Table 1.

TABLE 1

| | Toner Deposition of Background of Sheet |
|---|---|
| Example 1 | Grade 5 |
| Example 2 | Grade 4 |
| Example 3 | Grade 3 |
| Comparative Example 1 | Grade 1 |
| Comparative Example 2 | Grade 2 |

According to the toner replenishing method of the present invention, as previously mentioned, the toner is replenished only in a portion of the two-component dry developer as the toner concentration thereof is decreased so as to make up for the used toner in the course of the development. Since the toner is added only to the developer with a decreased toner concentration, the probability of contact of the replenished toner with the carrier is increased, and therefore, the toner particles can readily acquire the predetermined charge quantity. As a result, the scattering of toner particles, and the deposition of toner particles on the background can be minimized.

In addition, the toner tends to float over the carrier because the specific gravity of the toner is smaller than that of the carrier. Due to such behavior of toner, the probability that the replenished toner particles come in contact with the carrier particles is increasing when the toner is replenished in a mixing chamber containing the two-component dry developer with a decreased toner concentration from a toner-replenishing opening provided at a lower portion of the mixing chamber. As a result, the potential of the toner particles can readily rise, so that the scattering of toner particles, and the deposition of toner particles on the background can be efficiently minimized.

When the above-mentioned toner-replenishing opening is provided with a mesh screen with a mesh size larger than the particle size of the toner and smaller than the particle size of the carrier, the agglomerate of toner particles can be prevented from entering the mixing chamber in which the developer and the replenished toner are mixed and stirred. Therefore, the probability that the toner particles come in contact with the carrier particles is increasing, and the potential of the toner particles can readily rise. The scattering of toner particles, and the deposition of toner particles on the background can be efficiently minimized.

Japanese Patent Application No. 7-33055 filed on Jan. 30, 1995, and Japanese Patent Application filed on Dec. 28, 1995 are hereby incorporated by reference.

What is claimed is:

1. A development unit for developing latent electrostatic images formed on an electrophotographic photoconductor using a two component dry developer comprising a toner and a carder, comprising:

a developer container for holding a two part dry developer;

a developer supply member which supplies the developer from the developer container to the electrophotographic photoconductor, whereby toner in the developer is diminished, thereby leaving a used dry developer portion with a decreased toner concentration;

a mixing chamber receiving toner and the used dry developer portion and having a mixer for mixing the toner and the used dry developer portion;

a scraper positioned to scrape the used dry developer portion from said developer supply member and discharge substantially all of the scraped developer to said mixing chamber to be mixed with toner; and a developer transport means including an overflow edge for transporting the mixed developer from said mixing chamber to said developer container by causing the mixed developer to flow over the overflow edge.

2. A method for replenishing toner in a development unit including a developer supply member which supplies a two part dry developer from a developer container to an electrophotographic photoconductor, whereby toner in the developer is diminished, thereby leaving a used dry developer portion with a decreased toner concentration, said method comprising the step of:

scraping the used dry developer portion from said developer supply member;

discharging substantially all of the scraped developer to a mixing chamber;

supplying toner to the mixing chamber;

mixing the toner and the used dry developer portion in the mixing chamber to form a mixed developer; and transporting the mixed developer from said mixing chamber to said developer container by causing the mixed developer to flow over an overflow edge of the mixing chamber.

3. A development unit for developing latent electrostatic images formed on an electrophotographic photoconductor using a two component dry developer comprising a toner and a carrier, comprising:

a developer container for holding a two part dry developer;

a developer supply member which supplies the developer from the developer container to the electrophotographic photoconductor, whereby toner in the developer is diminished, thereby leaving a used dry developer portion with a decreased toner concentration;

a mixing chamber receiving the used dry developer portion;

a toner replenishing opening positioned at said mixing chamber to introduce at least part of the toner into said mixing chamber at substantially a lowermost portion of said mixing chamber;

a mixer in said mixing chamber for mixing the toner and the used dry developer portion;

a scraper positioned to scrape the used dry developer portion from said developer supply member and discharge the scraped developer to said mixing chamber to be mixed with toner; and developer transport means for transporting the mixed developer from said mixing chamber to said developer container.

4. The development unit of claim 3 including a screen with a mesh size larger than a particle size of the toner and smaller than a particle size of a carrier of the developer, said screen positioned to screen toner passing through said toner replenishing opening.

5. A method for replenishing toner in a development unit including a developer supply member which supplies a two part dry developer from a developer container to an electrophotographic photoconductor, whereby toner in the developer is diminished, thereby leaving a used dry developer portion with a decreased toner concentration, said method comprising the steps of:

scraping the used dry developer portion from said developer supply member;

discharging the scraped developer to a mixing chamber;

supplying at least part of the toner into said mixing chamber at substantially a lowermost portion of said mixing chamber;

mixing the toner and the used dry developer portion in the mixing chamber to form a mixed developer; and transporting the mixed developer from said mixing chamber to said developer container.

6. The method of claim 5 including the step of screening toner supplied to the mixing chamber using a screen with a mesh size larger than a particle size of the toner and smaller than a particle size of a carrier of the developer.

* * * * *

UNITED STATES PATENT AND TRADEMARK OFFICE

CERTIFICATE OF CORRECTION

PATENT NO. : 5,710,962

DATED : JANUARY 20, 1998

INVENTOR(S) : Tetsuo ISODA, ET AL.

It is certified that error appears in the above-identified patent and that said Letters Patent is hereby corrected as shown below:

Claim 1, column 9, line 5, change "carder" to --carrier--.

Signed and Sealed this

Second Day of February, 1999

*Attest:*

*Acting Commissioner of Patents and Trademarks*

*Attesting Officer*